US006848492B2

(12) United States Patent
Thomas

(10) Patent No.: US 6,848,492 B2
(45) Date of Patent: Feb. 1, 2005

(54) THERMAL INSULATING WINDOW AND ENTRANCE PORTABLE COVER/PAD

(76) Inventor: Donald Lee Thomas, 2508 Victoria Blvd., Hampton, VA (US) 23661

( * ) Notice: Subject to any disclaimer, the term of this patent is extended or adjusted under 35 U.S.C. 154(b) by 0 days.

(21) Appl. No.: 10/241,855

(22) Filed: Sep. 13, 2002

(65) Prior Publication Data

US 2004/0050507 A1 Mar. 18, 2004

(51) Int. Cl.[7] ..... A47H 13/00
(52) U.S. Cl. ..... 160/368.1; 160/376; 52/202
(58) Field of Search ..... 160/368.1, 376, 160/120, 241, 23, 270; 52/202, 203, 404; 49/61, 421, 465

(56) References Cited

U.S. PATENT DOCUMENTS 4,080,675 A * 3/1978 Kanowsky et al. ..... 5/345 R
4,131,150 A * 12/1978 Papadakis ..... 160/368 R
4,184,237 A * 1/1980 Blankenship ..... 29/91.1
4,193,225 A * 3/1980 Posner et al. ..... 49/465
4,389,827 A * 6/1983 Van Valkenburg ..... 52/511
4,409,275 A * 10/1983 Samowich ..... 428/138
4,423,574 A * 1/1984 Pierre ..... 52/202
4,479,339 A * 10/1984 Kroh ..... 52/468
4,513,548 A * 4/1985 Parker ..... 52/202
4,610,292 A * 9/1986 Hausmann et al. ..... 160/120
4,616,456 A * 10/1986 Parker ..... 52/202
4,759,194 A * 7/1988 Shapiro ..... 62/262
5,016,415 A * 5/1991 Kellis ..... 52/522
5,105,591 A * 4/1992 Leopold ..... 52/172
5,203,129 A * 4/1993 Johnson ..... 52/202
5,490,292 A * 2/1996 Auburn ..... 5/8
5,527,411 A * 6/1996 Jutte ..... 156/204
6,209,284 B1 * 4/2001 Porter ..... 52/794.1
6,223,490 B1 * 5/2001 Wessley et al. ..... 52/404.1
6,601,352 B1 * 8/2003 Obermeyer et al. ..... 52/202
6,698,157 B1 * 3/2004 Porter ..... 52/794.1
2002/0074152 A1 * 6/2002 Rockney et al. ..... 174/102 R
2002/0088244 A1 * 7/2002 Jennings et al. ..... 62/371
2002/0112409 A1 * 8/2002 Knowles ..... 52/19
2002/0162287 A1 * 11/2002 Bork et al. ..... 52/202

* cited by examiner

*Primary Examiner*—Bruce A. Lev
(74) *Attorney, Agent, or Firm*—Donald Grant Kelly

(57) ABSTRACT

An inexpensive, lightweight, reusable and detachable or removable insulation device for residential and commercial dwellings and similar heated structures. The device has an inner-portion insulating pad adapted to fit inside of a typical entrance or window unit framing. The device further has an outer-portion insulating pad adapted to overlap the window or entrance framing. The outer-portion insulating pad is provided fasteners so as to be secured to the building wall structure outside of the framing and surrounding the window or entrance framing by. During cold weather months, the present invention will greatly restrict warm air from escaping between small crevices in inept window systems by fitting firmly into window framing using a insulating material, thus creating a thermal barrier and improving the efficiency of the furnace by reducing the demand for electricity or fuel consumption.

14 Claims, 9 Drawing Sheets

THERMAL INSULATING WINDOW AND ENTRANCE PORTABLE COVER/PAD

BACKGROUND

1. Field of Invention

This invention relates to detachable insulating covers that are particularly suited for use in connection with windows and entrances of residential and commercial dwellings.

2. Prior Art

It is known from prior art that heat transfer through the windows and entrances of residential and commercial dwellings can be greatly reduced through the use of insulating covers.

Prior art has shown application of thin sheets of transparent plastic material and the like affixed to the windows and entrances. This method does offer some thermal insulation properties; however, in older dwellings with inept windows and entrances this method will have very little if any effect. In addition this application has problems with condensation build-up when in use.

Another solution of prior art in U.S. Pat. No. 4,610,292 (1986) suggested the use of insulated window shades and curtains. In this method window shades have a separate or detachable insulating layer behind the cloth fabric of shade or curtain. The insulating layer could be added during winter months and removed during the warmer months. This method did offer a portable way of insulating window areas; however this method did very little for drafty inept window systems for older dwellings. In cold weather months if a furnace is used to heat the dwelling, the produced warm air will rapidly escape through the drafty windows making it uncomfortable and thereby lowering the efficiency of the furnace or requiring a greater increase in fuel consumption to warrant eliminating the problem.

Another solution of prior art in U.S. Pat. No. 4,131,150 (1978) suggested the use of a window enclosure that is permanently mounted inside of window framing. The window enclosure used siding panels to remove or add insulating material. This method required a permanent alternation to the window framing.

These methods listed above are known to suffer from the following disadvantages:

a) poor thermal protections during cold weather months, by permitting warm air to escape between small crevices in inept window systems;

(b) neither system is designed to have an insulating layer fit firmly inside the window framing while utilizing surrounding wall element for fastening without altering the window and/or framing itself.

SUMMARY OF THE INVENTION—OBJECTS AND ADVANTAGES

A need for a long period of time has existed for a portable window insulating system that is simple and cost effective to install at first application, which will not alter the current window or entrance framing.

An important object of the present invention is to enable a person to remove the cover from the window framing is a simple manner.

Another important object of this invention is to provide a thermal barrier which seals around the edges of the window framing with an insulating layer and which may be adjusted to overlap around window framing edges onto the adjacent wall area.

During cold weather months the present invention, when installed inside a dwelling, will greatly restrict warm air and radiant heat from escaping between small crevices in inept window systems by fitting firmly into window framing using an insulating material.

This lightweight portable and removable insulating cover is placed over the interior-side generally (or the exterior) of typical commercial and residential building windows and entrances, providing added thermal protection inside of the dwelling, whereby creating a thermal barrier.

The present invention could be modified to have a viewer's opening for viewing out of the window/entrance when cover is installed. The present invention can also be modified to have decorative designs or embroidery on the exterior of device that is attractive and decorative to the eye of the beholder on the interior or exterior of the house.

This insulating cover can also be fabricated as a solid one-piece pre-molded insulating material using various molding/casting manufacturing techniques or using various fibrous felt-type insulating materials.

It is still another object of this invention to provide a complete window assembly that is simple, reusable, easy and economical to maintain.

This invention will be better understood and appreciated from the following detailed description of one embodiment thereof, selected for purposes of illustration and shown in the accompanying drawings.

DESCRIPTION OF THE PREFERRED EMBODIMENT

Figure 1:
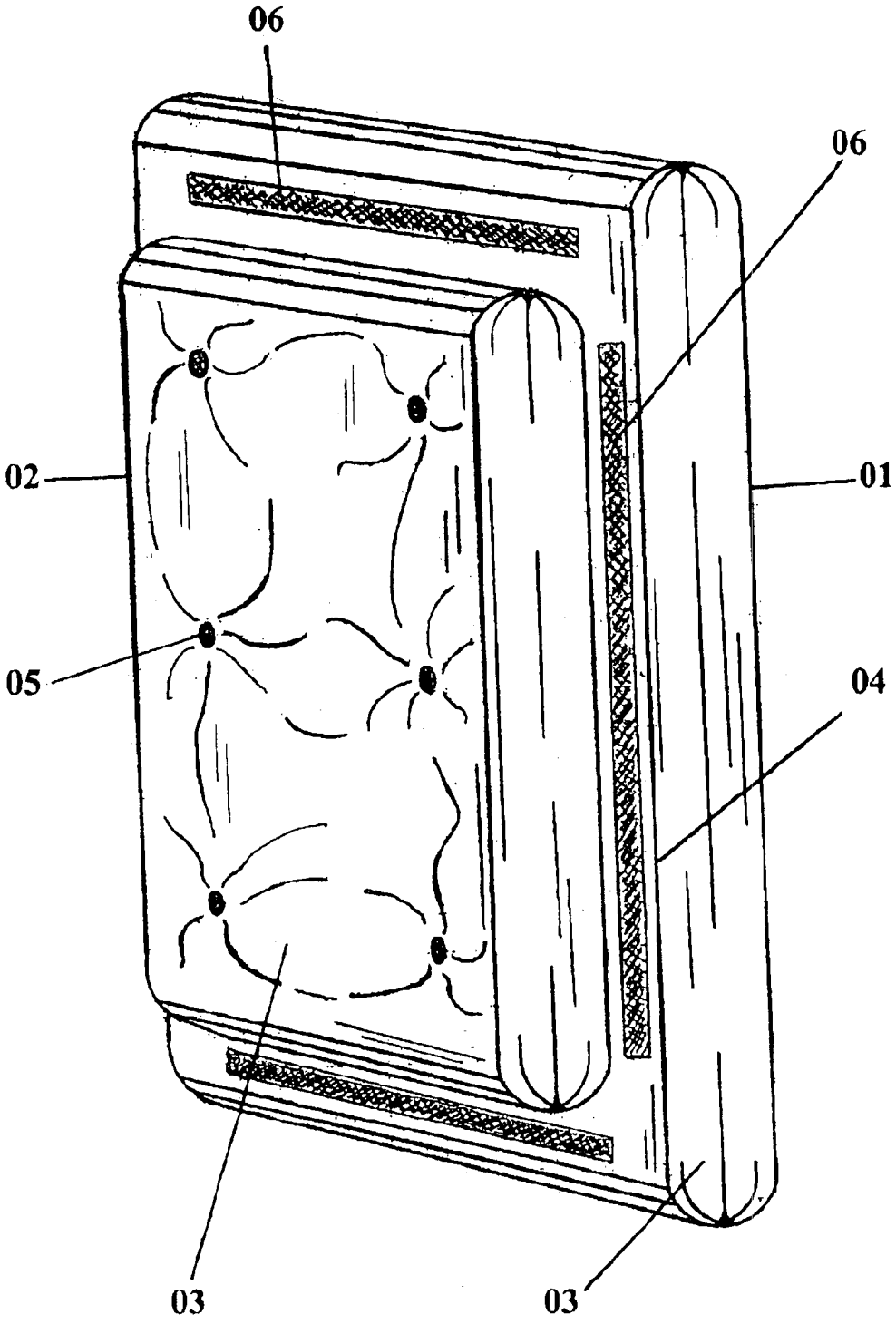
FIG. 1 is a perspective view of the portable insulation device of the present invention.

FIG. 1 shows the portable insulation device of the present invention. Shown in this view is an insulating core-element fabricated utilizing two functional sections which are the outer portion attachment pad section 01 and the inner portion insert pad section 02. Both the outer and inner portions or pads are illustrated here as completely and individually encased in a fabric material 03. As illustrated, the outer portion attachment pad section 01 is larger than the inner portion insert pad section in at least two dimensions, namely for example in height and width as viewed. Thus the attachment pad section effectively overlaps the insert pad section, and on this overlap segment are shown fasteners as will be further described herebelow. Said inner portion insert pad section is seen to protrude or jut out from the outer portion attachment pad section. All seams, corners, and edges of the fabric material 03 are bound together using heavy-duty nylon threading material 04. Spaced uniformly along the topside of the inner portion pad 02 are buttons associated with threading holes 05. Another set buttons associated with threading holes 05 is located on the backside of the outer portion pad 01, and spaced in a manner in that they are directly aligned with buttons and threading holes 05 of the inner portion pad 02. The buttons with threading holes 05 on both the outer portion pad 01 and the inner portion Pad 02 are illustrated as laced together by tightly drawn heavy-duty nylon threading material or lacing 04. The tightly drawn lacing passes through both the outer portion pad 01 and the inner portion pad 02. Along the perimeter of the outer portion pad 01 where it overlaps the inner portion pad 02 are uniformly spaced Velcro® hook and loop fasteners 06. Besides hook and loop fasteners, these may also include any other conventional fastening means, for example, snaps or hooks.

Figure 2:
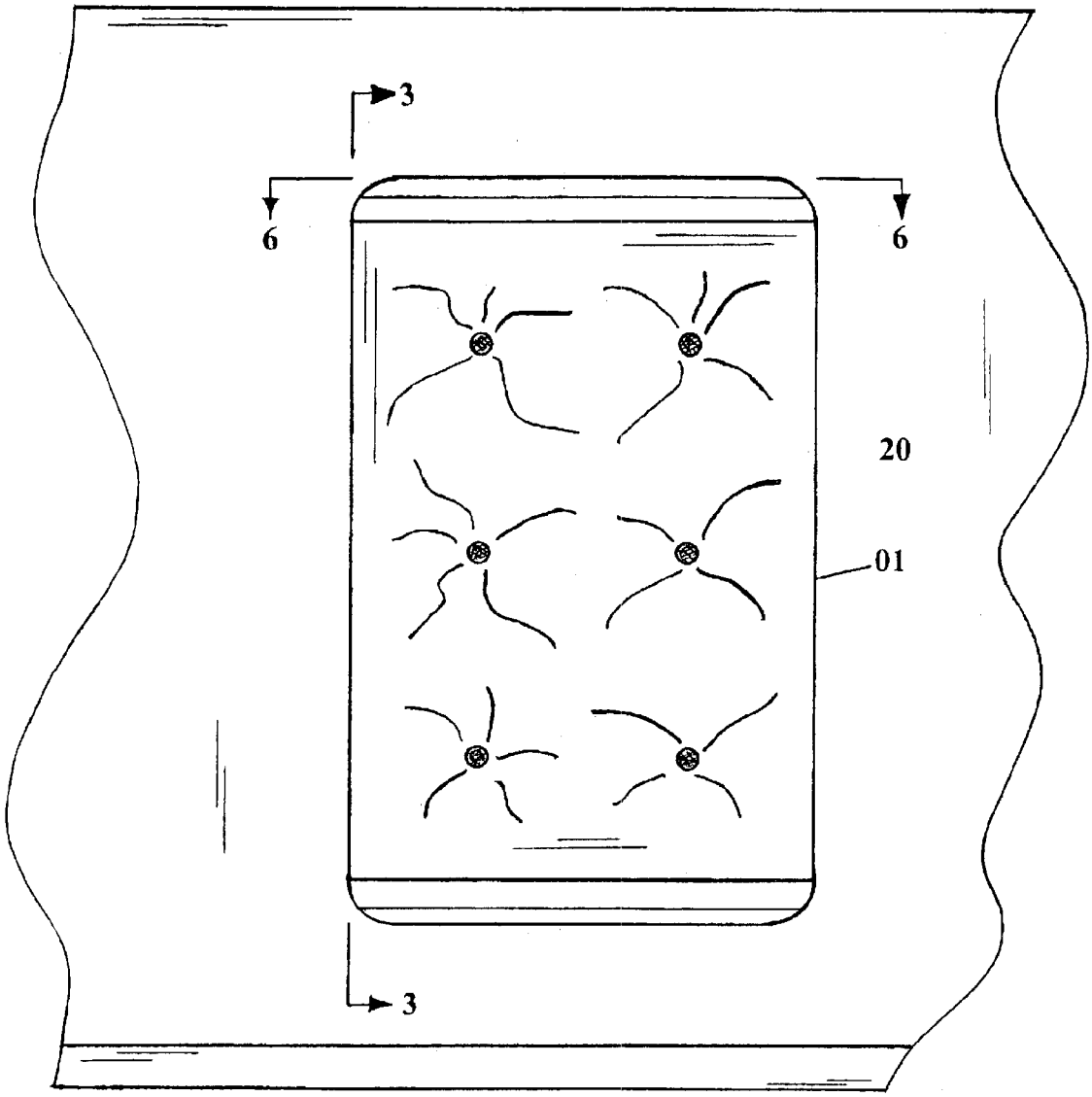
FIG. 2 is a partial elevation view showing the installation of the present invention covering the interior side of a window unit 21 inside a building.

FIG. 2 is a partial elevation view showing an inside building wall structure 20 with the portable insulation device installed over a window unit 21. The inner portion of pad 02 is fitted inside of the window framing area. The Outer portion pad 01 overlaps onto building wall structure 20 along the edges of the window framing.

Figure 2A:
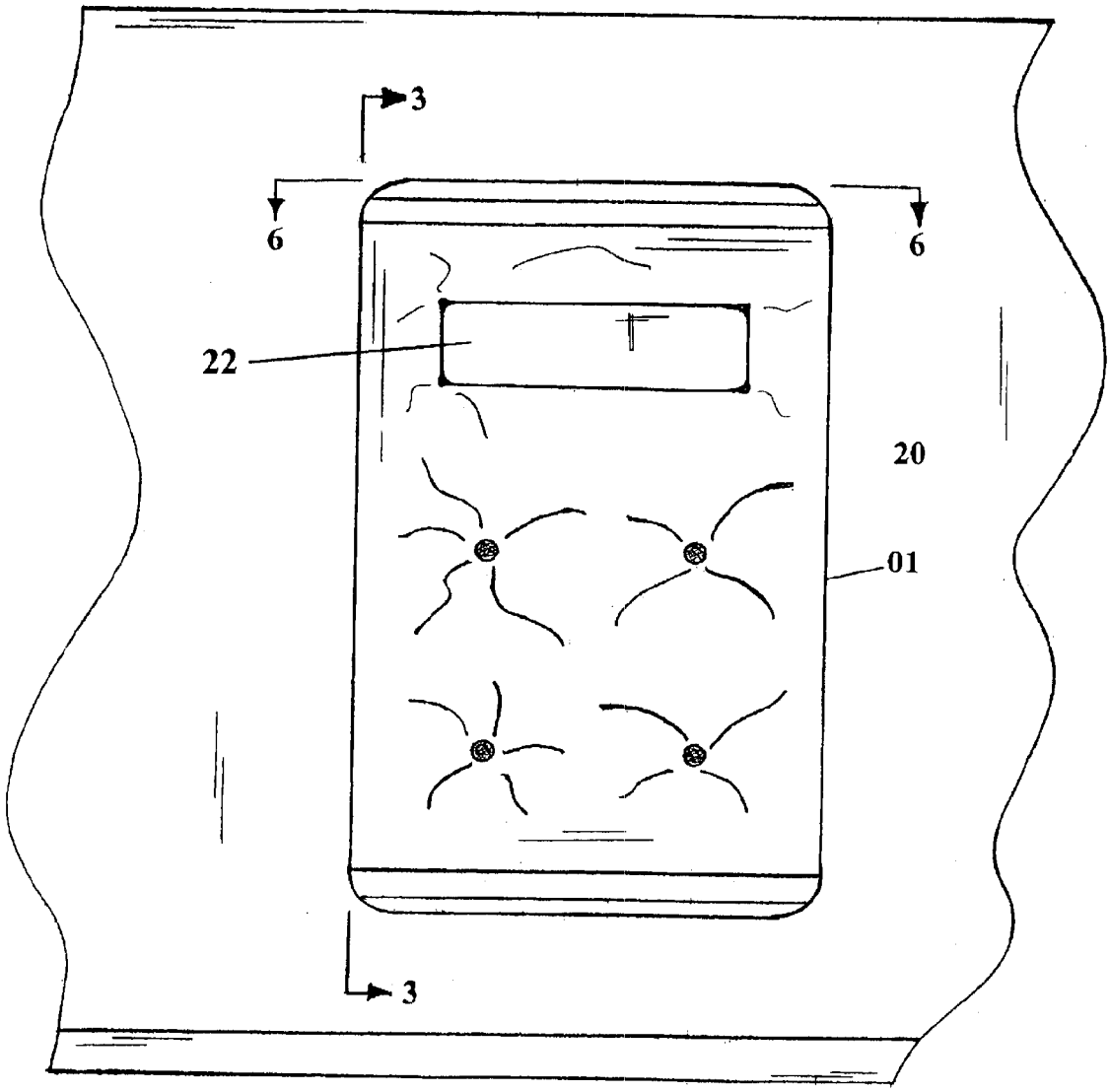
FIG. 2A is a modified version of FIG. 2 showing an option for the present invention wherein a viewer's opening is provided.

FIG. 2A is a modified version of FIG. 2, which is a partial elevation view showing a building wall structure 20 with the portable insulation device installed over a window unit 21. The inner portion pad 02 is fitted inside of the window framing area. The Outer portion pad 01 overlaps onto the building wall structure along the edges of the window framing.

This drawing also shows a viewer's opening 22 which allows the viewer inside a dwelling to view the environment on the outside of the dwelling when the present invention is installed. The viewer's opening shall be fabricated, for example, by providing an opening completely through the insulating cover then sealing the exposed fiberglass insulation 09 and polyester filler batting 07 by encasing them with fabric material 03. All seams shall be bound together by using heavy duty nylon threading Material 04.

Figure 3:
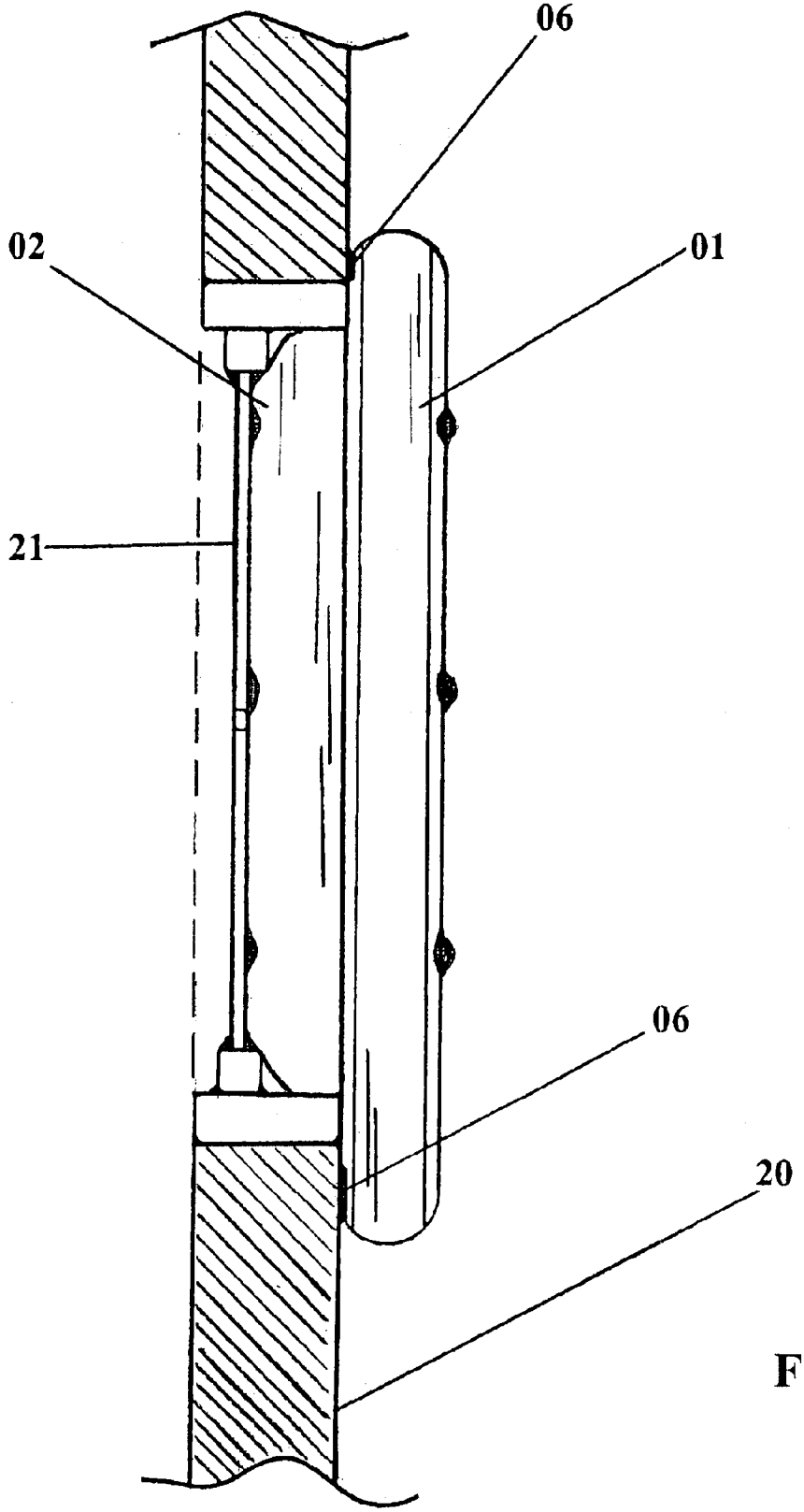
FIG. 3 is a cross sectional transverse view of a window unit showing the insulating cover insertion wherein the view is taken along lines 3—3 of FIG. 2.

FIG. 3 is a cross sectional transverse view of window unit 21 and the portable insulation device taken along 3—3 of FIG. 2. The inner portion pad 02 is fitted inside of the window framing area and is seen as substantially filling said surrounding framing area. The outer portion pad 01 overlaps onto the building wall structure 20 along the edges of the window unit 21 framing. Along the perimeter of the building wall structure 20 encircling the window unit 21 are mounted fasteners 06. These fasteners 06 are firmly attached using matching spacing to fasteners 06 attached to the topside of the outer portion pad 01. All Sides and corners of outer portion pad 01 are checked to make sure that all fasteners 06 are attached to corresponding fasteners mounted to building wall structure 20 encircling the window unit 21.

Figure 4:
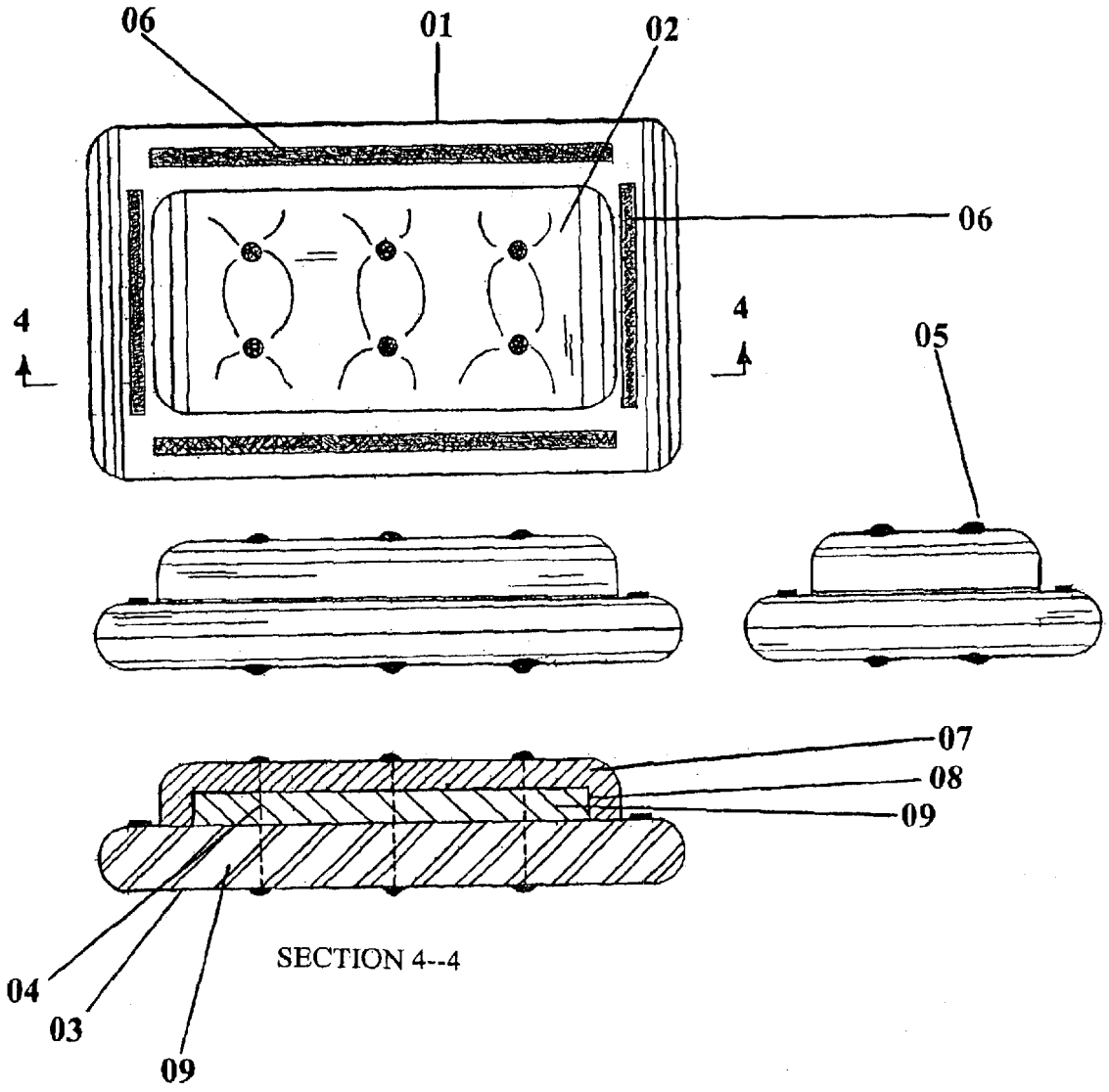
FIG. 4 is a detailed orthographic view of the portable insulation device illustrated in FIG. 1.

FIG. 4 is a detailed orthographic and cross-sectional view of the portable insulation device. The orthographic view shows the relationship and arrangement of an embodiment of the outer portion attachment pad section 01 to the inner portion insert pad section 02.

Cross-sectional view taken along lines 4—4 shows the internal features of an embodiment of the present Invention. The inner portion pad 02 internally may be fabricated mostly of Polyester filler Batting 07. A sheet of general use grade aluminum foil 08 may be sandwiched between polyester filler batting 07 and fiberglass felt type insulation 09. In this embodiment, the outer surfaces of both the outer portion pad 01 and inner portion pad 02 are completely encased in a fabric material 03. Spaced uniformly along the topside of the inner portion pad 02 are buttons with threading holes 05. A second set of buttons with threading holes 05 is placed on the backside of the outer portion pad 01, which is spaced in a manner in that they are directly aligned with buttons with threading holes 05 of the inner portion pad 02. The buttons with threading holes 05 on both the outer portion pad 01 and the inner portion pad 02 are laced together by tightly drawn heavy duty nylon threading material 04. This sectional view shows the tightly drawn lacing passing through both the outer portion pad 01 and the inner portion pad 02. Along a substantial portion of the perimeter of outer portion attachment pad section 01 are uniformly spaced fasteners 06, for example Velcro® hook and loop fasteners.

Figure 5:
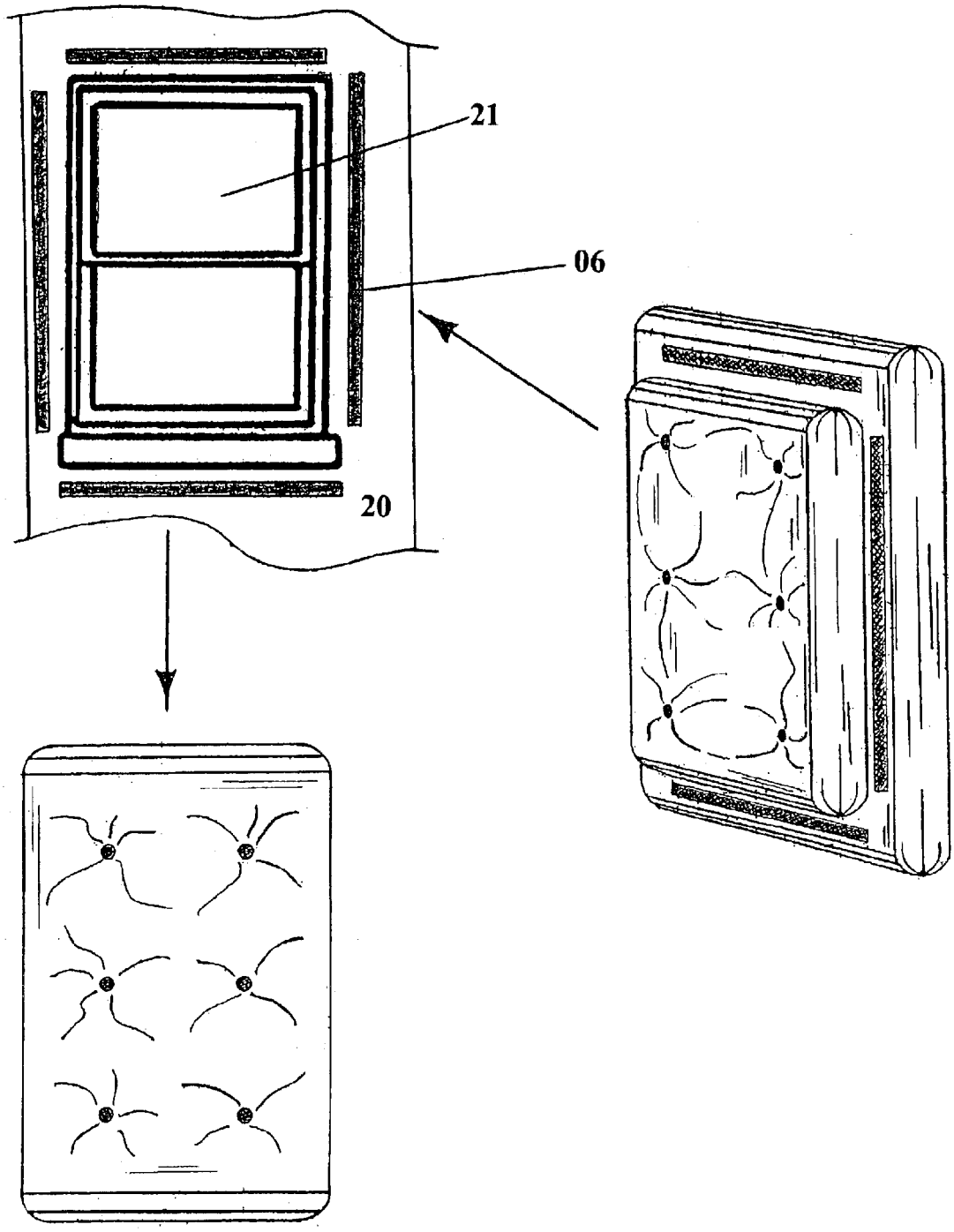
FIG. 5 is a typical installation and application method for the present invention.

FIG. 5 shows the portable insulation device typical installation method. The present invention is mounted over the window unit 21 with the inner portion pad 02 fitting inside window unit 21 framing. This embodiment shows an elevation view of Velcro® hook and loop type fasteners 06 installed on the building wall structure 20 which surround the Window Unit 21.

Figure 6:
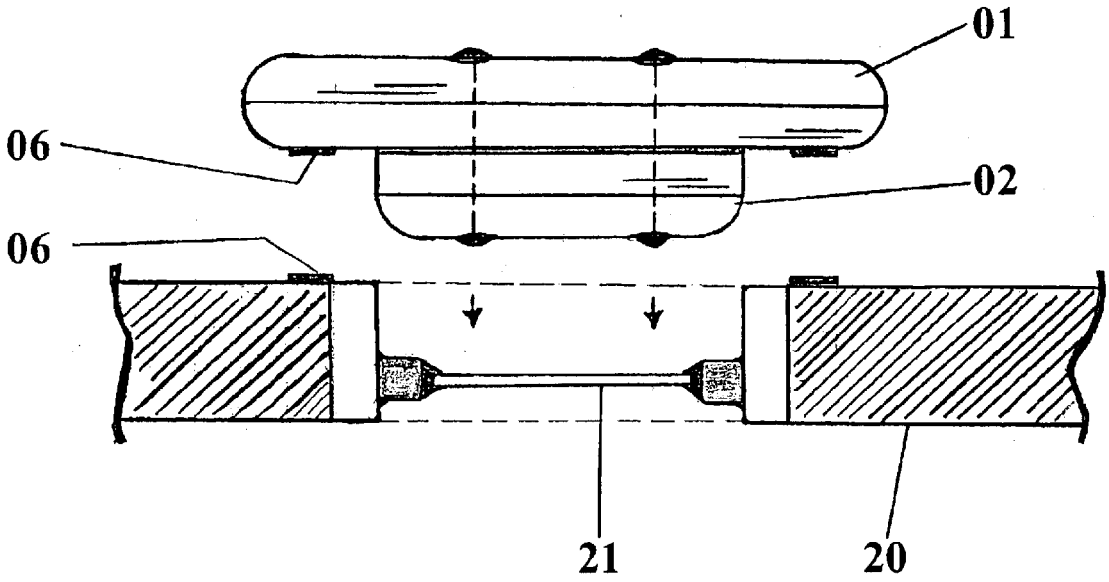
FIG. 6 is a cross-sectional view showing the portable insulation device insertion along lines 6—6 of FIG. 2.

FIG. 6 is a longitudinal cross-section view of the building wall structure 20 and window unit 21 taken along 6—6 of FIG. 2. This view shows the insertion of the portable insulation device into the framing of window unit 21. This cross-sectional view also shows the alignment of the fasteners 06 surrounding the window unit 21 framing and fasteners 06 attached to the top-side of outer portion pad 01.

Figure 6A:
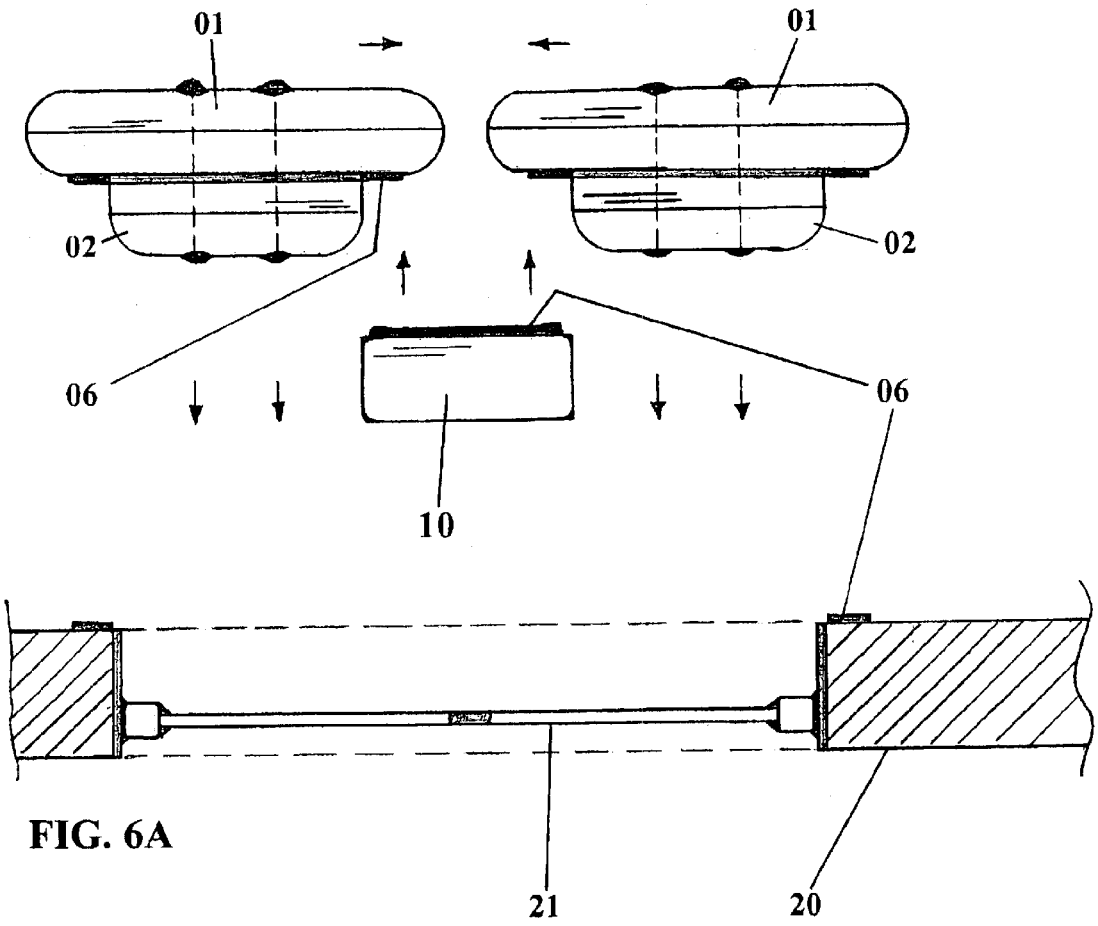
FIG. 6A is an alternative method of installing the present invention by using an extension adapter, whereby permitting the present invention to be installed over irregular, large and over-sized window units.

FIG. 6A is a modified version of the embodiment illustrated in FIG. 6 which is a longitudinal cross-section view of the building wall structure 20 and window unit 21 taken along 6—6 of FIG. 2. This view shows the insertion of the portable insulation device into the framing of window unit 21. In addition to the features explained in FIG. 6, this modified version shows the present invention insertion for an over-sized window unit 21 using the extension adapter 10. This is a bridging device to attach two insulating covers, whereby permitting the present invention to be expandable and extendable for installation over irregular, large or oversized window unit 21. The extension adapter 10 is rectangular and elongated in proportion with one elongated side having a fastener 06 attached to its exterior surface. The general length of the extension adapter 10 shall be proportional to the length of the joining inner port on pads 02 of the present invention. The general width of the extension adapter 10 shall be proportional to general distance between the joining inner portion pads 02 of the present invention while the joining outer portion pads 01 of the present invention are directly in contact. The elongated side of extension adapter 10 with the attaching fastener 06 shall be firmly connected to the corresponding fastener 06 attached along the common perimeter on the topside of the joining outer portion pads 01 of the present invention.

Figure 6B:
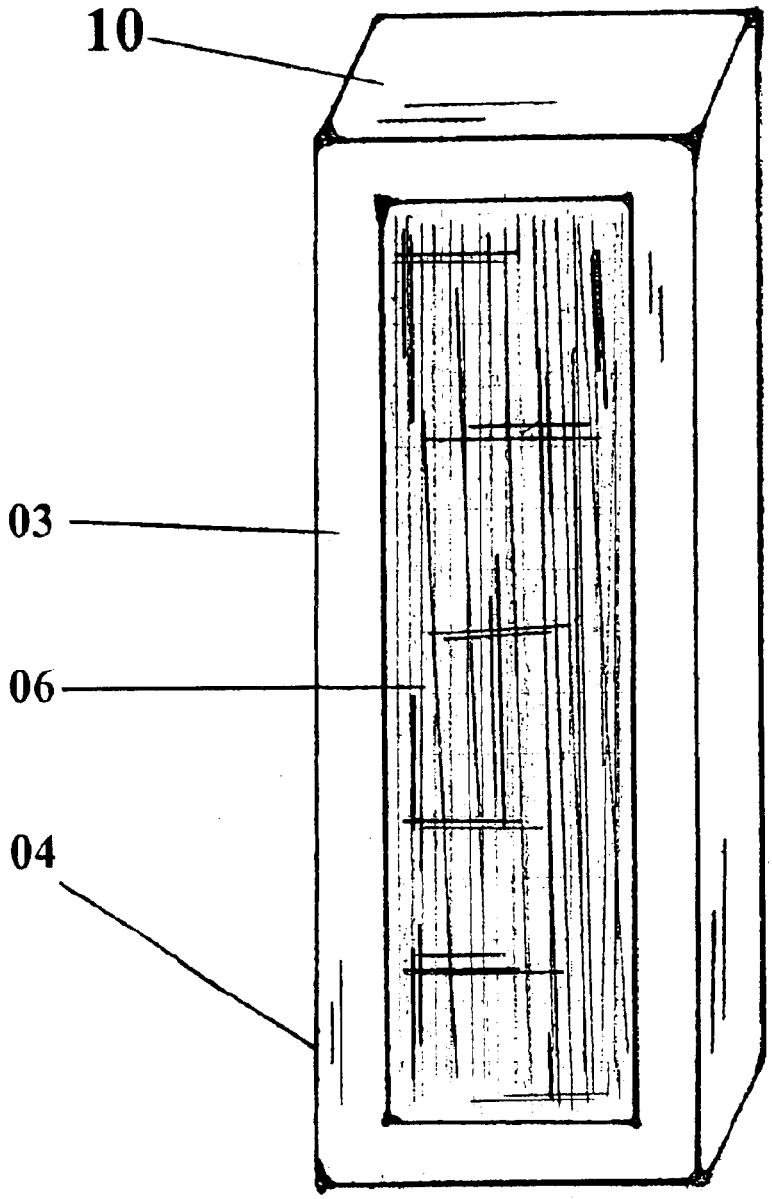
FIG. 6*b* is a perspective view of the extension adapter identified in FIG. 6A.

FIG. 6B is a perspective view of the extension adapter 10 identified in FIG. 6A. The extension adapter 10 includes a fiberglass felt type insulation 09 core element which is encased in fabric material 03. All seams, corners, and edges of the Fabric Material 03 are bound together using Heavy-duty nylon threading material 04. The extension adapter 10 is rectangular and elongated in proportion with one elongated side having a fastener 06 attached to its outer surface along its length.

Summary, Ramifications, and Scope

As previously mentioned the following reference part numerals have additional advantages in that;

Fabric material 03 may be made of any suitable material such as flame-retardant material, cotton, plastic, polyester, paper with aluminum foil backing, nylon, and the like.

The fiberglass felt-type insulation 09 may be any conventional type of insulation such as fiberglass, fiberglass sheets with aluminum foil or its equivalent, various plastic foams, foam rubber, and any conventional insulation material including flame retardant material, which can control the transfer of heat and prevent the escape of warm air from the interior of the dwelling.

In addition to Velcro® hook and loop fasteners 06, other fasteners could be used such as snaps, hooks, or any other types of conventional fastening means.

While nylon threading material 04 has been mentioned, it will be obvious that in addition to nylon threading material 04, snap fasteners, staples, epoxy or other glue-like material or heat seals can be used.

A particular advantage of the present invention lies in the fact that edge portion of the outer pad 01 proficiently seals around the edges of the window unit 21. This seal greatly restricts the passage of warm air from inside the dwelling and is easily removable. If the fasteners 06 are appropriately spaced along the window unit framing 21, the insulating section of the present invention will greatly improve the air tightness of the space between the window unit 21 and the insulating cover.

Referring to FIG. 5 fasteners 06 are shown attached to the wall area surrounding window unit 21. These fasteners could also be mounted directly to the window unit 21 framing. This method could benefit fixed sash commercial window units with metal framing.

The outer portion pad 01 could be constructed omitting the fiberglass insulation 09 shown in FIG. 4, thus just using a layer of fabric material 03 or vinyl and plastic-like materials. This method would provide a smooth, flush and sleek appearance inside of the dwelling, thus lending itself to various decorative and ornamental designs, patterns, pictures, textures, writings and embroidery.

Also an additional advantage of the present invention lies in the fact that the materials selected to manufacture this device; when used in combination could produce stain resistant, water-resistant and moisture-resistant properties which would improve the effectiveness of the device. This could include the fabric material 03, fibrous polyester filler batting 07, and fiberglass insulation 09.

Also an additional advantage of the present invention lies in the fact that the materials selected to manufacture this device; when used in combination could make the device a bullet-proof or resistant barrier when installed at windows and entrances. This ramification could have great law enforcement and military potential.

Although the description above contains many specifics, these should not construed as limiting the scope of the present invention but as merely providing illustrations of the presently preferred embodiments.

Thus the scope of this invention should be determined by the appended claims and their legal equivalents, rather than by the examples given.

I claim the following:

1. In a portable insulation device for thermally insulating a window or entranceway in a building wall structure, wherein said window or entranceway is recessed within an opening having a surrounding framing area with outer framing edges, the improvement comprising:

said portable insulation device having an outer portion attachment pad section and an inner portion insert pad section;

said inner portion insert pad section being smaller in at least two dimensions than said outer portion attachment pad section, such that said outer portion attachment pad section overlaps said inner portion insert pad section;

said portable insulation device outer portion attachment pad section, where it overlaps said inner portion insert pad section is adapted to be engaged along said building wall structure beyond said framing edges such that said outer portion attachment pad section overlaps onto said wall structure along said framing edges;

said portable device inner portion insert pad section protrudes from said outer portion attachment pad section and is adapted to be fitted inside of said framing area so as to substantially fill said opening within said surrounding framing area;

said outer portion attachment pad section further including fasteners adapted to be mounted to said building wall structure encircling and sealing said framing edges;

whereby, in use, said portable device is positioned against said window or entranceway, such that the device inner portion insert pad section is fitted within the framing area substantially filling said opening, and such that the device outer portion attachment pad section extends beyond said framing edges and overlapping onto said wall structure where said portable device inner and outer portions are held in place by said fasteners on said building wall.

2. The portable insulation device of claim 1, wherein said inner portion insert pad section and said outer portion attachment pad section are fabricated as a solid one-piece pre-molded insulating material.

3. The portable insulation device of claim 1, wherein said inner portion insert pad section and said outer portion attachment pad section are at least two individual functional sections bound together.

4. The portable insulation device of claim 1, wherein each said inner portion insert pad section and each said outer portion attachment pad section is completely and individually encased by a fabric material.

5. The portable insulation device of claim 1, wherein said fasteners are hook and loop fasteners or snap fasteners.

6. The portable insulation device of claim 1, wherein said inner portion insert pad section and said outer portion attachment pad section both include at least one viewer opening therethrough.

7. In a portable insulation device for thermally insulating a window or entranceway in a building wall structure, wherein said window or entranceway is recessed within an opening having a surrounding framing area with framing edges, the improvement comprising:

said portable insulation device including at feast two separate insulating units, each said unit having an outer portion attachment pad section and an inner portion insert pad section;

said inner portion insert pad section of each said unit being smaller in at least two dimensions than said outer portion attachment pad section, such that said outer portion attachment pad section overlaps said inner portion insert pad section;

each said outer portion attachment pad section, where it overlaps said inner portion insert pad section, is adapted to be engaged along, and to be secured to, said building wall structure beyond said framing edges such that said outer portion attachment pad section also overlaps onto said wall structure along and beyond said framing edges;

each said inner portion insert pad section protrudes from said outer portion attachment pad section and is adapted to be fitted inside of said framing area within said surrounding framing area;

said at least two separate insulating units including therebetween at least one extension adapter having attachment elements to mutually attach said units and thereby extend said portable insulating device such that said inner portion insert pad sections substantially fill said opening within said surrounding framing area;

each said outer portion attachment pad section further includes fasteners adapted to be secured to said at least one extension adapter and further adapted to be secured to said building wall structure for encircling and sealing said framing edges;

whereby said extension adapter enables said portable insulation device, when positioned against an oversized window or entranceway, to be extended such that the device inner portion insert pad sections of the insulating units are fitted within the framing area substantially filling said opening, and so that the device outer portion attachment pad sections of the insulating units extend beyond said framing edges and overlap onto said wall structure where said portable device inner portion insert pad sections, said extension adapter, and said outer attachment pad sections are held in place by said attaching elements and said fasteners.

8. The portable insulation device of claim 7, wherein said outer portion attachment pad section and said inner portion insert pad section of each of said at least two separate insulating units are fabricated as a solid one-piece premolded insulating material.

9. The portable insulation device of claim 7, wherein said outer portion attachment pad section and said inner portion insert pad section of each of said at least two separate insulating units are individual functional sections mutually bound together.

10. The portable insulation device of claim 7, wherein each said outer portion attachment pad section and each said inner portion insert pad section of each of said at least two separate insulating units is completely and individually encased by a fabric material.

11. The portable insulation device of claim 7, wherein said fasteners are hook and loop fasteners or snap fasteners.

12. The portable insulation device of claim 7, wherein said outer portion attachment pad section and said inner portion insert pad section of each of said at least two separate insulating units both have at least one viewer opening therethrough.

13. In a detachable insulating cover device for thermally insulating a window or entranceway in residential and commercial dwellings, wherein said window or entranceway is recessed within an opening having a surrounding framing area with framing edges, the improvement comprising:

said detachable insulating cover device is a pad including two distinct portions, said two portions comprising an outer portion attachment pad section and an inner portion insert pad section;

said inner portion insert pad section protrudes from said outer portion attachment pad section and is adapted to be fitted inside of said opening directly against said window or entranceway so as to substantially fill said opening within said surrounding framing area to provide a thermal barrier and prevent condensation;

said inner portion insert pad section being smaller in at least two dimensions than said outer portion attachment pad section, such that said outer portion attachment pad section overlaps said inner portion insert pad section;

said outer portion pad section where it overlaps said inner portion insert pad section is further adapted to extend beyond said surrounding framing area and along said building wall structure and beyond the framing edges such that said outer portion attachment pad section further overlaps onto said wall structure;

each said outer portion attachment pad section further includes fasteners adapted to be secured to said building wall structure encircling and thereby sealing said framing edges;

whereby said detachable insulating cover is positioned directly against said window or entranceway within said frame such that the device inner portion insert pad section serves to limit condensation and resist passage of air in and around said window or entranceway, while said outer portion attachment pad section attached to said building wall beyond said framing area serves to resist passage of air around said frame.

14. The portable insulation device of claim 13, wherein said inner portion insert pad section and said outer portion attachment pad section are at least two individually functional sections mutually bound together.

* * * * *